US006180305B1

(12) United States Patent
Ackley et al.

(10) Patent No.: US 6,180,305 B1
(45) Date of Patent: Jan. 30, 2001

(54) ORGANIC PHOTORECEPTORS FOR LIQUID ELECTROPHOTOGRAPHY

(75) Inventors: James H. Ackley, Oakdale; James E. Lindquist, Stillwater; Zbigniew Tokarski, Woodbury, all of MN (US)

(73) Assignee: Imation Corp., Oakdale, MN (US)

( * ) Notice: Under 35 U.S.C. 154(b), the term of this patent shall be extended for 0 days.

(21) Appl. No.: 09/504,456

(22) Filed: Feb. 16, 2000

(51) Int. Cl.[7] ..... G03G 5/147
(52) U.S. Cl. ..... 430/66; 430/67; 399/159
(58) Field of Search ..... 430/66, 67

(56) References Cited

U.S. PATENT DOCUMENTS

| | | | | |
|---|---|---|---|---|
| 3,434,832 | * | 3/1969 | Joseph et al. | 430/67 |
| 3,753,709 | * | 8/1973 | Staudenmayer et al. | 430/67 |
| 4,006,020 | * | 2/1977 | Polastri | 430/67 |
| 4,062,681 | * | 12/1977 | Lewis et al. | 430/67 |

(List continued on next page.)

FOREIGN PATENT DOCUMENTS

| | | |
|---|---|---|
| 0454484 | 6/1997 | (EP) . |
| 327039 | 5/1998 | (EP) . |
| 85239300 | 10/1985 | (JP) . |
| 87265117 | 10/1987 | (JP) . |
| 8920779 | 2/1989 | (JP) . |
| 9122439 | 2/1991 | (JP) . |
| WO 95/02853 | 1/1995 | (WO) . |

OTHER PUBLICATIONS

Cais et al., "Antiplasticization and Abrasion Resistance of Polycarbonates in the Charge–Transport Layer of an Organic Photoconductor," Macromolecules 1992, 25, 4588–4596.

Brennan et al., "Poly(hydroxy amide ethers): new High–Barrier Thermoplastics," Macromolecules 1996, 29, 3707–3716.

Brennan et al., "Amorphous Phenoxy Thermoplastics with an Extraordinary Barrier to Oxygen," Macromolecules 1995, 28, 6694–6696.

Research Disclosure No. 10942, "Multilayer electrographic elements", 1973.

E. Gutoff, "Premetered Coating," Modern Coating & Drying Technology, VCH Publishers, Inc., NY 1992, pp. 117–120.

Borsenberger and Weiss, "Photoreceptors: Organic Photoconductors," Ch. 9, Handbook of Imaging Materials, Ed. Arthur S. Diamond, Marcel & Dekker, Inc. 1991.

* cited by examiner

*Primary Examiner*—Roland Martin
(74) *Attorney, Agent, or Firm*—Amelia A. Buharin

(57) ABSTRACT

An organic photoreceptor ("OPR") including a barrier layer formed from a barrier layer coating composition including a cellulosic resin, methylvinyl ether/maleic anhydride copolymer, a polyamide, a crosslinker, and a combination thereof, provides sufficient protection to the organic photoreceptor from damage due to corona-induced charge injection; is substantially inert with respect to the organic photoconductive layer; exhibits sufficient resiliency to withstand shear, compressional and tensional forces exerted on the belt as it passes through an electrophotographic system when the photoreceptor is used in an endless belt form; and provides sufficient protection to limit or prevent a liquid toner from contacting the organic photoconductor that may result in crazing and/or cracking of the organic photoreceptor during use.

41 Claims, 2 Drawing Sheets

U.S. PATENT DOCUMENTS

| | | | | |
|---|---|---|---|---|
| 4,439,509 | | 3/1984 | Schank | 430/67 |
| 4,565,759 | * | 1/1986 | Tsutsui | 430/67 |
| 4,565,760 | | 1/1986 | Schank | 430/66 |
| 4,595,602 | | 6/1986 | Schank | 430/67 |
| 4,600,669 | | 7/1986 | Ng et al. | 430/47 |
| 4,600,673 | | 7/1986 | Hendrickson et al. | 430/66 |
| 4,606,934 | | 8/1986 | Lee et al. | 430/67 |
| 4,658,756 | | 4/1987 | Ito et al. | 430/67 |
| 4,804,602 | | 2/1989 | Buettner et al. | 430/42 |
| 4,923,775 | | 5/1990 | Schank | 430/66 |
| 4,996,125 | | 2/1991 | Sakaguchi et al. | 430/66 |
| 5,096,796 | * | 3/1992 | Mammino et al. | 430/67 |
| 5,124,219 | * | 6/1992 | Shintani et al. | 430/66 |
| 5,124,220 | | 6/1992 | Brown et al. | 430/67 |
| 5,275,853 | | 1/1994 | Silvis et al. | 428/412 |
| 5,300,990 | | 4/1994 | Thompson | 430/112 |
| 5,420,675 | | 5/1995 | Thompson et al. | 430/117 |
| 5,596,398 | | 1/1997 | Woo et al. | 430/125 |
| 5,650,253 | | 7/1997 | Baker et al. | 430/119 |
| 5,652,078 | | 7/1997 | Jalbert et al. | 430/67 |
| 5,659,851 | | 8/1997 | Moe et al. | 399/165 |
| 5,723,242 | | 3/1998 | Woo et al. | 430/66 |
| 5,754,928 | | 5/1998 | Moe et al. | 399/249 |
| 5,758,236 | | 5/1998 | Teschendorf et al. | 399/591 |
| 5,916,718 | | 6/1999 | Kellie et al. | 430/45 |
| 5,976,744 | * | 11/1999 | Fuller et al. | 430/66 |
| 6,020,098 | * | 2/2000 | Bretscher et al. | 430/66 |

ORGANIC PHOTORECEPTORS FOR LIQUID ELECTROPHOTOGRAPHY

BACKGROUND OF THE INVENTION

This invention relates to organic photoreceptors suitable for use in electrophotography and, in particular, in liquid electrophotography.

In electrophotography, a photoreceptor in the form of a plate, belt, or drum having an electrically insulating photoconductive element on an electrically conductive substrate is imaged by first uniformly electrostatically charging the surface of the photoconductive layer, and then exposing the charged surface to a pattern of light. The light exposure selectively dissipates the charge in the illuminated areas, thereby forming a pattern of charged and uncharged areas. A liquid or solid toner is then deposited in either the charged or uncharged areas to create a toned image on the surface of the photoconductive layer. The resulting visible toner image can be transferred to a suitable receiving surface such as paper. The imaging process can be repeated many times.

Both single layer and multilayer photoconductive elements have been used. In the single layer embodiment, a charge transport material and charge generating material are combined with a polymeric binder and then deposited on the electrically conductive substrate. In the multilayer embodiment, the charge transport material and charge generating material are in the form of separate layers, each of which can optionally be combined with a polymeric binder, deposited on the electrically conductive substrate. Two arrangements are possible. In one arrangement (the "dual layer" arrangement), the charge generating layer is deposited on the electrically conductive substrate and the charge transport layer is deposited on top of the charge generating layer. In an alternate arrangement (the "inverted dual layer" arrangement), the order of the charge transport layer and charge generating layer is reversed.

In both the single and multilayer photoconductive elements, the purpose of the charge generating material is to generate charge carriers (i.e., electron-hole pairs) upon exposure to light. The purpose of the charge transport material is to accept one of these charge carriers and transport them through the charge transport layer in order to discharge a surface charge on the photoconductive element.

To produce high quality images, particularly after multiple cycles, it is desirable for the charge transport material to form a homogeneous solution with the polymeric binder and remain in solution. In addition, it is desirable to maximize the amount of charge which the charge transport material can accept (indicated by a parameter known as the acceptance voltage or "$V_{acc}$"), and to minimize retention of that charge upon discharge (indicated by a parameter known as the residual voltage or "$V_{res}$").

Liquid toners generally produce superior images compared to dry toners. However, liquid toners also can facilitate stress crazing in the photoconductive element. Stress crazing, in turn, leads to printing defects such as increased background. It also degrades the photoreceptor, thereby shortening its useful lifetime. The problem is particularly acute when the photoreceptor is in the form of a flexible belt included in a compact imaging machine that employs small diameter support rollers (e.g., having diameters no greater than about 40 mm) confined within a small space. Such an arrangement places significant mechanical stress on the photoreceptor, and can lead to degradation and low quality images.

One solution developed has been to provide a barrier layer to an organic photoreceptor. Conventional barrier layers have been formed from a variety of materials, examples of which include crosslinkable siloxanol-colloidal silica hybrids (as disclosed, e.g., in U.S. Pat. Nos. 4,439,509; 4,606,934; 4,595,602; and 4,923,775); a coating formed from a dispersion of hydroxylated silsesquioxane and colloidal silica in an alcohol medium (as disclosed, e.g., in U.S. Pat. No. 4,565,760); a polymer resulting from a mixture of polyvinyl alcohol with methyl vinyl ether/maleic anhydride copolymer (e.g., in U.S. Pat. No. 5,124,220); a coating formed from an organic polymer (such as polyacrylates, polyurethanes, polyvinyl acetals, sulfonated polyesters, and mixtures of polyvinyl alcohol with methylvinylether/maleic anhydride copolymer) and silica (e.g., in International Publication No. WO 95/02853); and polyvinyl butyral crosslinked with methylvinylether/maleic anhydride copolymer, such as that commercially available under the trade designation GANTREZ AN 169, from ISP, Wayne, N.J.

However, it has been found that these barrier layers do not provide an organic photoconductive layer with adequate protection from liquid contact when a liquid toner is utilized. Furthermore, it has been found that these barrier layers do not possess sufficient resiliency to be used in belt form, as evidenced by stress fractures that developed in the charge transport layers when subjected to stress testing in the presence of a liquid toner.

SUMMARY OF THE INVENTION

Thus, what is yet needed is an organic photoreceptor including a barrier layer that possesses improved resistance to liquid toners while maintaining other suitable electrophotographic properties, such as stability under charge-discharge cycling. It is also highly desirable that such a barrier layer possesses sufficient resiliency so that the organic photoreceptor is useful in belt form.

Accordingly, one aspect of the present invention provides an organic photoreceptor that includes an organic photoconductor having a first major surface and a second major surface; a barrier layer on the first major surface of the photoconductor formed from a barrier layer coating composition comprising a cellulosic resin, a methylvinylether/maleic anhydride copolymer, and a crosslinking agent. The photoreceptor also includes a release layer.

Another aspect of the present invention provides an electrophotographic system for producing a multi-colored image. The system includes a photoreceptor, as described above; a positioner for movably positioning the photoreceptor in order that a given portion of the photoreceptor sequentially advances through a plurality of locations in a single pass; an eraser for erasing any previously accumulated charge from the photoreceptor; a charger for charging the photoreceptor to a predetermined charge level; at least one image-wise exposing device for exposing the photoreceptor with radiation modulated in accordance with an image data for one of a plurality of colors in order to partially discharge the photoreceptor to a first discharge level to produce an image-wise distribution of charges on the photoreceptor corresponding to the image data for the one of a plurality of colors; at least one applicator to apply a first color liquid toner comprising charged particles of the first color and transparent counter-ions, using an electrode electrically biased to a voltage of between the predetermined charge level and the first discharge level, to the photoreceptor as a finction of the image-wise distribution of charges on the photoreceptor to form a first color image, wherein a second substantially uniform predetermined photoreceptor charge level results such that it is lower than the first predetermined charge level but being sufficiently high to subsequently repel liquid toner in areas not subsequently further discharged; and a transferor to transfer at least the first color image and the second color image to a medium to form the multi-colored image.

The electrophotographic system, as described above, may further include a second image-wise exposing device for exposing the photoreceptor with radiation modulated in accordance with the image data for a second of the plurality of colors in order to partially discharge the photoreceptor to produce an image-wise distribution of charges on the photoreceptor corresponding to the image data for the second of the plurality of colors in registration with the first color image, wherein the second image-wise exposing device produces the image-wise distribution of charges without erasing the photoreceptor subsequent to the first image-wise exposing of the photoreceptor; and a second applicator to apply a second color liquid toner to the image-wise distribution of charges on the photoreceptor to form a second color image in registration with the first color image.

In a photoreceptor in accordance with the present invention, the cellulosic resin is preferably selected from the group of a modified methyl cellulose, an unmodified methyl cellulose, and a combination thereof. Preferably, the barrier layer coating composition includes the cellulosic resin in an amount from about 0.2% solids by weight to about 15.0% solids by weight, more preferably, in an amount of 0.6% solids by weight to about 2.5% solids by weight, and, even more preferably, in an amount of 0.75% solids by weight.

Preferably, the barrier layer coating composition includes the copolymer in an amount of about 1.2% solids by weight to about 0.3% solids by weight, more preferably, about 0.9% solids by weight to about 0.6% solids by weight, and, even more preferably, about 0.75% solids by weight.

In accordance with the present invention, the barrier layer coating composition preferably includes a ratio of the cellulosic resin to the copolymer of about 0.4:1.0 to about 1.0:0.4, more preferably, the ratio of the cellulosic resin to the copolymer is about 1:1. Thus, in one preferred embodiment, the barrier layer coating composition includes the cellulosic resin in an amount of about 0.75% solids by weight of the cellulose resin and the copolymer in an amount of about 0.75% solids by weight of the copolymer.

Preferably, the crosslinking agent is a bis aldehyde and, more preferably, the cross-linking agent is glyoxal. Preferably, the barrier layer coating composition includes the cross-linking agent in an amount from about 1.0% solids by weight to about 10.0% solids by weight, and, more preferably, from about 1.0% solids by weight to about 7.5% solids by weight of the sum amount of the resin and the copolymer in the barrier layer coating composition.

The barrier layer coating composition may further include an optional component, such as a nonionic surfactant.

Another aspect of the present invention provides an organic photoreceptor including an organic photoconductor having a first major surface and a second major surface; a barrier layer on the first major surface of the photoconductor formed from a barrier layer coating composition comprising a cellulosic resin, a methlyvinylether/maleic anhydride copolymer, and a polyamide; and a release layer.

Preferably, the barrier layer coating composition comprises a ratio of polyamide:copolymer:cellulose from about 1:0:1 to about 1:1:6. In this embodiment, the barrier layer coating composition preferably includes the cellulosic resin in an amount up to about 15%, more preferably about 0.5% solids by weight to about 2.0% and, even more preferably, 1.5% solids by weight.

The barrier layer coating composition in accordance with this embodiment preferably includes the copolymer in an amount up to about 7.5%, more preferably, about 0.15% solids by weight to about 1.0% and, even more preferably, 0.25% solids by weight.

According to this embodiment of the present invention, the barrier layer coating composition preferably includes the polyamide in an amount up to about 15%, more preferably about 0.24% solids by weight to about 2.0% and, even more preferably, 0.25% solids by weight.

The barrier layer coating composition in accordance with this embodiment of the present invention can further include a crosslinker, an optional component, and a combination thereof.

Preferably, a barrier layer formed from any one of the barrier layer coating compositions in accordance with the present invention has a thickness of about 0.2 micrometers to about 1.0 micrometers and, more preferably, from about 0.4 micrometers to about 0.8 micrometers. In one embodiment, the organic photoreceptor is in a form of a flexible belt.

In accordance with the present invention, an organic photoreceptor may further include a tie layer, wherein the tie layer is positioned between the barrier layer and the release layer. In one embodiment, the tie layer is formed from a tie layer coating composition preferably including a polyetheramine having aromatic ether and amine repeating units in its backbone and pendant hydroxyl moieties. In another embodiment, the tie layer is formed from a tie layer coating composition preferably including a polyamide. In yet another embodiment, the tie layer is formed from a composition preferably including a polyvinyl acetal and a methylvinyl ether/maleic anhydride copolymer. In a further embodiment, the tie layer is formed from a composition preferably including a polyvinyl acetal, methylvinyl ether/maleic anhydride copolymer, and a crosslinking agent.

The invention provides organic photoreceptors featuring a combination of good mechanical and electrostatic properties. Specifically, photoreceptors in accordance with the present invention possess improved resistance to liquid toner-induced stress crazing and increased protection from damage due to corona-induced charge injection. High quality images produced using a photoreceptor in accordance with the present invention are maintained after repeated cycling.

DETAILED DESCRIPTION

Figure 1A:
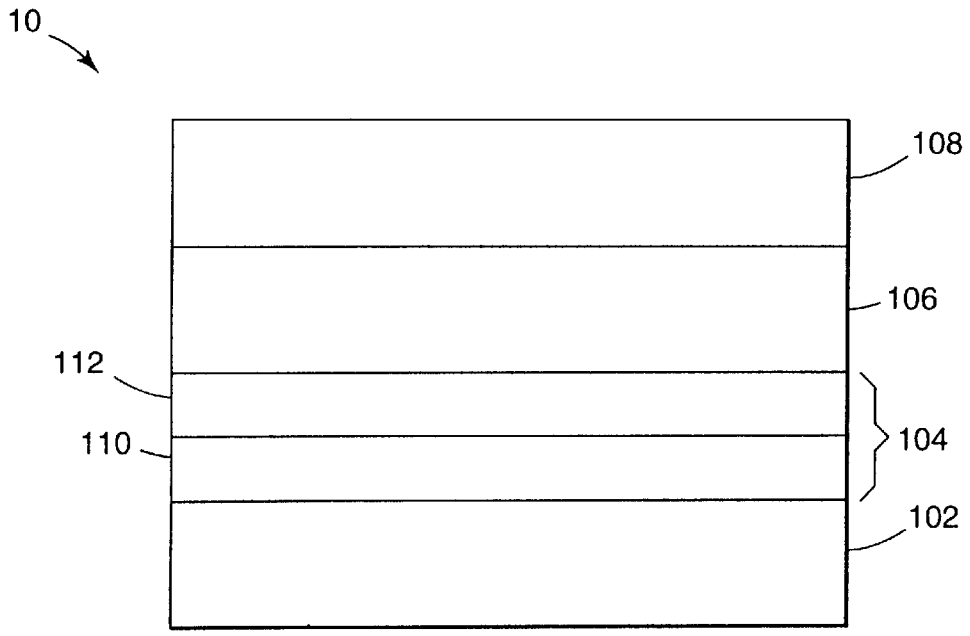
FIGS. 1*a* and 1*b* are schematic illustrations of embodiments of organic photoreceptors in accordance with the present invention.

The present invention provides an organic photoreceptor 10 that preferably includes, as shown in FIG. 1*a*, a conductive substrate 102, a photoconductive element 104, a barrier layer 106, and a release layer 108. Preferably, the photoconductive element 104 is a bilayer construction featuring a charge generating layer 110 and a separate charge transport layer 112. The charge generating layer 110 may be located intermediate the conductive substrate 102 and the charge transport layer 112, as shown in FIG. 1*a*. Alternatively, the photoconductive element may be an inverted construction in which the charge transport layer is intermediate the conductive substrate and the charge generating layer, i.e., the locations of layers 110 and 112 are reversed from that show in FIG. 1*a*. The organic photoreceptor may be in the form of a plate, drum, or belt, with flexible belts being preferred.

Figure 1B:
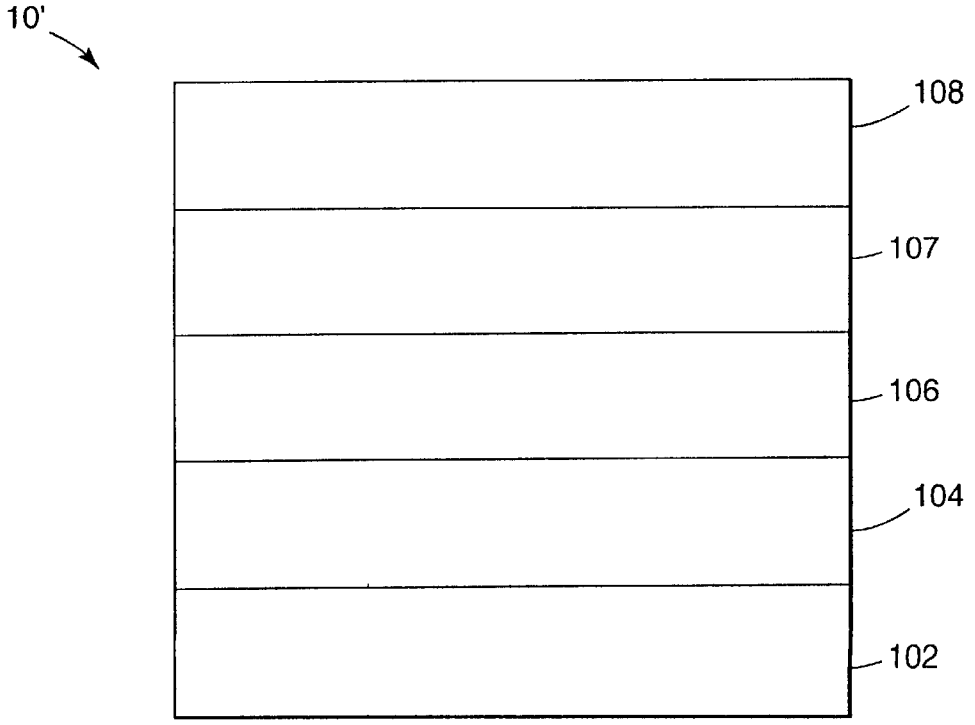

Referring to FIG. 1*b*, another embodiment in accordance with the present invention is shown, wherein an organic photoreceptor 10' includes a conductive substrate 102, a photoconductive element 104, a barrier layer 106, a tie layer 107, and a release layer 108. Consistent with a photoreceptor construction in accordance with the present invention, one skilled in the art will readily appreciate that other layers (e.g., a charge injection barrier layer) can be present in the photoreceptor.

Photoconductive Element

As mentioned above, a photoconductive element preferably includes a charge generating layer and a charge transport layer. Generally, the charge generating layer includes a charge generating compound dispersed within a binder. The charge generating compound is a material that is capable of absorbing light to generate charge carriers. Examples of suitable compounds are well known and include dyestuffs and pigments (such as metal-free phthalocyanine pigments from Zeneca, Inc., and Y-form metal-free phthalocyanine pigments).

Charge transport compounds suitable for use in the charge transport layer of the photoconductors of the present invention should be capable of supporting the injection of photogenerated holes or electrons from the charge generation layer (depending upon the charging polarity) and allowing the transport of these holes or electrons through the charge transport layer to selectively discharge the surface charge. Preferable hole transport compounds comprise aromatic amines, hydrazone compounds, oxadiazole compounds, oxazole compounds, pyrazoline compounds, triphenyldiamine compounds, and triarylmethane compounds. Particularly preferred transport materials are described in U.S. patent application Ser. No. 09/172,379, filed Oct. 14, 1998, entitled "Organophotoreceptors for Electrophotography Featuring Novel Charge Transport Compounds" (Mott et al.). Polymeric charge transport materials such as polyvinyl carbazole may also be used. Additional materials are disclosed in Borsenberger and Weiss, "Photoreceptors: Organic Photoconductors," Ch. 9, *Handbook of Imaging Materials*, Ed. Arthur S. Diamond, Marcel Dekker, Inc., 1991.

The charge transport compound may act as a binder. It is also possible to combine the charge transport compound and/or the charge generating compound with a separate polymeric binder. Examples of suitable binders include styrenebutadiene copolymers, modified acrylic polymers, vinyl acetate polymers, styrene-alkyd resins, soya-alkyl resins, polyvinyl butyral, polyvinylchloride, polyvinylidene chloride, acrylonitrile, polycarbonate, polyacrylic and methacrylic esters, polystyrene, polyesters, and combinations thereof. Examples of suitable polycarbonate binders include aryl polycarbonates, such as aryl polycarbonates including poly(4,4-dihydroxy-diphenyl-1,I-cyclohexane) ("Polycarbonate Z 200; Z 300; Z 400; Z 800," all available from Mitsubishi Engineering Plastics, White Plains, N.Y.) and poly(Bisphenol A carbonate)-co-4,4'(3,3,5-trimethyl cyclohexylidene) diphenol.

A particularly useful binder is polyvinyl butyral. This material has free hydroxyl groups available for reaction, e.g., with isocyanate groups which may be present in the charge transport layer, the charge generating layer, additional layers, or a combination thereof.

Barrier Layer

Although barrier layers included in photoreceptors are well known, they do not possess or are inadequate in one or more of the following performance characteristics: (a) providing sufficient protection to the organic photoreceptor from damage due to corona-induced charge injection; (b) substantially inert with respect to the organic photoconductive layer; (c) exhibiting sufficient resiliency to withstand shear, compressional and tensional forces exerted on the belt as it passes through the system (described below) when the photoreceptor is used in an endless belt form; and (d) providing sufficient protection to limit or prevent a liquid toner from contacting the organic photoconductor. For example, conventional barrier layers are typically formed from materials such as crosslinkable siloxanol-colloidal silica, a dispersion of hydroxylated silsesquioxane and colloidal silica in an alcohol medium, a polymer resulting from a mixture of polyvinyl alcohol with methyl vinyl ether/maleic anhydride copolymer, an organic polymer (e.g., polyacrylates, polyurethanes, polyvinyl acetals, sulfonated polyesters, mixtures of polyvinyl alcohol with methylvinylether/maleic anhydride copolymer and silica, and methyl cellulose) and polyvinyl butyral crosslinked with methylvinylether/maleic anhydride copolymer. However, many of these barrier layers may not possess the necessary resistance to the paraffinic solvents used in liquid toners (solvents such as NORPAR and ISOPAR from Exxon, USA) to protect the organic photoreceptor from the solvent in the liquid toner while maintaining suitable electrostatic and print quality properties.

In accordance with the present invention, an organic photoreceptor includes a barrier layer formed from a barrier layer coating composition including a cellulose resin, a methylvinyl ether/maleic anhydride copolymer, and a crosslinking agent. Preferably, the cellulose resin is selected from the group consisting of a modified cellulose, an unmodified cellulose, and a combination thereof. More preferably, the cellulose resin is selected from the group of methyl cellulose, ethyl cellulose, hydroxypropyl cellulose, a cellulose ester, and a combination thereof. Suitable cellulose resins are commercially available, such as methyl cellulose and ethyl cellulose available from Aldrich Chemical, Milwaukee, WI; and hydyroxypropyl cellulose, available under the trade designation KLUCEL, froin Hercules Chemical, Wilmington, Del.

As mentioned above, a barrier layer coating composition also includes a methylvinyl ether/maleic anhydride copolymer, such as that commercially available under the trade designation of GANTREZ AN series, from ISP Chemical, Wayne, N.J.

As mentioned above, a barrier layer coating composition in accordance with the present invention preferably includes a crosslinking agent. Preferably, the crosslinking agent is selected from the group of a bis aldehyde, an organosilane, a melamine resin, and a combination thereof. Preferably, the bis aldehyde is an aliphatic dialdehyde and, even more preferably, the cross-linking agent is glyoxal, such as that commercially available under the trade designation GLYOXAL 40, from Aldrich Chemical, Milwaukee, Wis. Preferably, the organosilane is one that contains one or more functional groups. For example, one suitable organosilane containing functional groups is an acetoxy-epoxy functional silsequioxane, such as that commercially available under the trade designation SYL-OFF 297, from Dow Corning Corporation.

A barrier layer coating composition preferably includes a suitable amount of resin and copolymer in order to enhance protection of the organic photoconductor from the solvent typically included in the toner (as indicated by the reduction of cracks or crazing in an organic photoreceptor after testing as described herein) while simultaneously providing sufficient protection to the organic photoreceptor from damage due to corona-induced charge injection (as indicated by the voltage from the laser charge up and discharge tests described herein).

Accordingly, in one preferred embodiment, the barrier layer coating composition comprises a ratio of the resin to the copolymer of about 0.4:1.0 to about 1.0:0.4 and, more preferably, the ratio of the resin to the copolymer is about 1:1.

Preferably, the resin is included in the barrier layer coating composition in an amount from about 0.2% and, more preferably from about 0.6% solids by weight, to an amount of about 15.0%, preferably to about 2.5%, of the resin in the barrier layer coating composition. Even more preferably, the barrier layer coating composition includes from about 0.6% to about 1.5% and, most preferably, about 0.7:5% solids by weight of the resin.

Preferably, the copolymer is included in the barrier layer coating composition in an amount less than about 1.2% solids by weight, more preferably less than about 0.9% and, preferably, more than about 0.3% solids by weight, and more preferably about 0.6% solids by weight of the copolymer in the barrier layer coating composition. Most preferably, the barrier layer coating composition includes about 0.75% solids by weight of the copolymer in the barrier layer coating composition.

Preferably, the cross-linking agent is present in the barrier layer coating composition in an amount from about 1.0% solids by weight, more preferably from about 2.5% solids by weight to an amount of about 10.0% solids by weight, and more preferably about 7.5% solids by weight of the sum amount of the resin and the copolymer in the barrier layer coating composition. Most preferably, the barrier layer coating composition includes about 5.0% solids by weight of the sum amount of the resin and the copolymer.

In another embodiment, an organic photoconductor can include a barrier layer formed from a barrier layer coating composition including a cellulosic resin, a methylvinyl ether/maleic anhydride copolymer (each as described above), and a polyamide. Optionally, a crosslinker may also be included, such as that described above. Preferably, the polyamide is a soluble polyamide as is known in the art. For example, suitable polyamide materials are commercially available under the trade designations ULTRAMID, from BASF Corporation, Mount Olive, N.J.; and AMILAN, from Toray Ltd., Japan. In this embodiment, the barrier layer coating composition preferably includes a ratio of polyamide:copolymer:cellulose from about 1:0:1 to about 1:1:6.

Preferably, the barrier layer coating composition includes the polyamide in an amount from about 0.125% and, more preferably, from about 0.24% solids by weight, to an amount of about of about 15% and, preferably to about 4%, solids by weight. Even more preferably, the barrier layer coating composition includes from about 0.24% to about 2% and, most preferably, about 0.25% solids by weight of the polyamide.

Preferably, the barrier layer coating composition includes the copolymer in an amount up to about 7.5 solids by weight and, more preferably, from about 0.125 % to about 1.0% solids by weight. Even more preferably, the barrier layer coating composition includes from about 0.15% to about 1.0% and, most preferably, about 0.2.5% solids by weight of the copolymer.

Preferably, the barrier layer coating composition includes the cellulosic resin in an amount up to about 15% solids by weight and, more preferably, from about 0.5% solids to an amount of about of about 15% and, preferably to about 2% solids by weight. Even more preferably, the barrier layer coating composition includes from about 0.5% to about 2% and, most preferably, about 1.5% solids by weight of the cellulosic resin.

In this embodiment, a barrier layer performs as a barrier layer and as a tie layer, each as described herein, thus eliminating the potential need for a tie layer in an organic photoconductor in accordance with the present invention.

Optional Components

Other optional components may be added to the barrier layer coating composition including surfactants, plasticizers, anti-static agents, wetting agents, anti-foaming agents, conductive additives, and fillers, to name a few, so long as the barrier layer characteristics (such as those mentioned above) are not impaired. One preferred optional component is a surfactant, preferably a nonionic surfactant, such as that commercially available under the trade designation TRITON X-100, from Aldrich Chemical, Milwaukee, Wis. If present, the surfactant is preferably in a barrier layer coating composition in an amount preferably from about 0.0001% to about 1.0%, more preferably from about 0.01% to about 0.05%, and, even more preferably, from about 0.02% to about 0.03% by weight.

Another preferred optional component is silica particles. The silica particles preferably are colloidal silica having average diameter from 5 to 200 nm. As used herein, "colloidal silica" refers to a dispersion of silicon dioxide particles in which the silica particles can range in size from about 5 to about 30 nm. One suitable colloidal silica is commercially available under the trade designation SNOTEX O, from Nissan Chemical Industries, Ltd., Tarrytown, N.Y. Preferably, the colloidal silica is present in a barrier layer coating composition in an amount of less than about 20%, more preferably, less than about 15%, and even more preferably from about 12% to about 6% of total solids.

Suitable conductive additives include conductive pigments, conductive polymers, doped conductive polymer compositions such as conductive organic molecules, and conductive pigments (or conductive particles). The amount of conductive additive is preferably less than 35%, more preferably less than about 20% by weight of the barrier layer.

Preferably, a barrier layer coating composition is applied to an organic phctoconductor using any conventional coating technique, such as air doctor coating, blade coating, air knife coating, squeeze coating, reverse roll coating, transfer roll coating, gravure coating, kiss coating, cast coating, spray coating, dip coating, bar coating, extrusion coating, die coating (including slot die coating), for example. Preferably, the barrier layer coating composition is applied to an organic photoconductor at a thickness such that a barrier layer formed has a dry thickness from about 0.4 micrometers to about 0.8 micrometers.

Surprisingly, it was found that organic photoreceptors including such barrier layers exhibited improved resistance to solvent while maintaining suitable charge-discharge properties under testing conditions equivalent print cycles in the thousands, as exemplified herein. Advantageously, it was found that a barrier layer formed from a barrier layer coating composition including methyl cellulose, a melhylvinylether/maleic anhydride copolymer, and crosslinking agent exhibited decreased crazing when exposed to the toner solvent and improved electrostatic characteristics as compared to a conventional barrier layer, such as a barrier layer containing methyl cellulose and maleic anhydride, as is described in U.S. Pat. No. 5,124,220 (Brown et al.). Furthermore, it was surprisingly found that the addition of the cross-linker improved adhesion of the barrier layer to the charge generating layer of the organic photoconductor without adversely affecting the electrostatic characteristics of the photoreceptor, as is demonstrated herein.

Release layers

A release layer is typically applied over the barrier layer and must adhere well to the barrier layer, preferably without the need for adhesives. Additionally, the release layer must not significantly interfere with the charge transport characteristics of the photoreceptor. Conventional release layers are formed from a variety of well known materials including fluorinated polymers (such as those described in U.S. Pat. Nos. 4,996,125 and 5,723,242, for example), siloxane polymers, silanes, silicone polymers (such as that described in U.S. Pat. No. 4,600,673, for example), polyethylene, and polypropylene, to name a few. Other suitable compositions for forming a release layer including a siloxane polymer with a low content of finctional groups capable of crosslinking are described in U.S. Pat. No. 5,652,078 (Jalbert et al.) and in copending U.S. patent application Ser. No. 09/504,461, filed Feb. 16, 2000 (Li et al.).

In one preferred embodiment, a release layer includes a composition including (a) from zero to about 30 parts by weight of a polymer having the formula

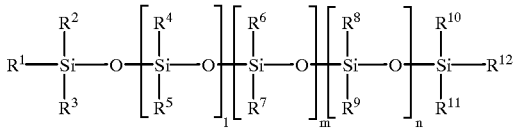

wherein $R^1$, $R^2$, $R^3$, $R^6$, $R^7$, $R^{10}$, $R^{11}$, and $R^{12}$ are each independently selected from an alkyl group, an alkenyl group, an aryl group, and an aralkyl group, such that at least one of $R^6$ and $R^7$ is an alkenyl group, $R^4$, $R^5$, $R^8$, and $R^9$ are each independently selected from an alkyl group, an aryl group, and an aralkyl group, l, m, and n are each independently integers so long as the polymer contains greater than 3 mol % vinyl-containing siloxane groups;

(b) more than about 20 parts by weight of a polymer selected from the group of

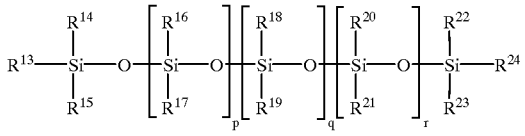

wherein $R^{13}$, $R^{14}$, $R^{15}$, $R^{18}$, $R^{19}$, $R^{22}$ $R^{23}$ and $R^{24}$ are each independently selected from an alkyl group, an alkenyl group, an aryl group, and an aralkyl group, such that at least two of $R^{13}$, $R^{14}$, $R^{15}$, $R^{18}$, $R^{19}$, $R^{22}$, $R^{23}$, and $R^{24}$ alkenyl groups, $R^{16}$, $R^{17}$, $R^{20}$, and $R^{21}$ are each independently selected from an alkyl group, an aryl group, and an aralkyl group, p, q, and r are each independently integers so long as the polymer has less than 3 mol % vinyl-containing siloxane groups; a (vinyl siloxy)(siloxy)-modified silica having a vinyl content of less than about 0.6 vinyl equivalent/kg; and a combination thereof; and (c) greater than about 0 parts to about 20 parts by weight of a cross-linking agent of the formula

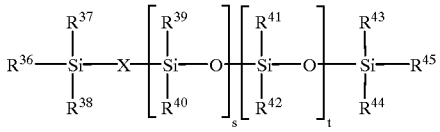

wherein $R^{36}$, $R^{37}$, $R^{38}$, $R^{43}$, $R^{44}$, and $R^{45}$ are each independently selected from hydrogen, an alkyl group, an aryl group, and an aralkyl group, $R^{39}$, $R^{40}$, $R^{41}$, and $R^{42}$ are each independently selected from hydrogen, an alkyl group, and an aryl group, X is O, or a divalent organic linking group, and s and t are independently integers so long as there are at least two functional groups capable of cross-linking per molecule.

Tie layers

Optionally, an organic photoreceptor in accordance with the present invention can have a structure including an organic photoconductor, a barrier layer (as described above), a tie layer, and a release layer. In one embodiment, the tie layer can be positioned between the barrier layer and the release layer to enhance adhesion of the release layer to the barrier layer in the organic photoreceptor. In another embodiment, the tie layer can be positioned between the charge generating layer and the barrier layer to enhance adhesion of the barrier layer to the organic photoconductor. One with ordinary skill in the art will readily appreciate that an organic photoreceptor according to the present invention may possess a variety of layered configurations, such as the presence of a tie layer between the release layer and the barrier layer as well as the presence of a tie layer between the charge generating layer and the barrier layer.

Preferably, a tie layer is formed from a tie layer coating composition comprising an organic polymer. The term "organic polymer" refers to a material that is formed from a carbon chain or ring structure containing hydrogen and, optionally, heteroatoms such as sulfur, oxygen, nitrogen, and a combination thereof. Preferably, an organic polymer suitable for use in the present invention include those selected from the group of polyetheramines, polyvinyl acetals, polyamides, methylvinyl ether/maleic anhydride copolymer, and combinations thereof. Preferably, an organic polymer is present in a tie layer coating composition in an amount of less than about 30% solids in the tie layer coating composition.

One preferred type of organic polymer for use in a tie layer in accordance with the present invention is a polyetheramine having aromatic ether/amine repeating units in its backbone and pendant hydroxyl moieties. Namely, a suitable polyetheramine is preferably formed by reacting diglycidyl ethers of dihydric aroimatic compounds (e.g., the diglycidyl ether of bisphenol-A, hydroquinone, or resorcinol) with amines, preferably having no more than two amine hydrogens per molecule (e.g., piperazine or ethanolamine), as is described in U.S. Pat. No. 5,275,853 (Silvis et al.). Preferred polyetheramines are commercially available under the trade designations XU 19073 and XU 19040, both from The Dow Chemical Company, Midland, Mich.

Another preferred type of organic polymer for use in a tie layer in accordance with the present invention is a polyamide, preferably, a soluble polyamide as is known in the art. For example, suitable polyamide materials are commercially available under the trade designations ULTRAMID, from BASF Corporation, Mount Olive, N.J.; and AMILAN, from Toray Ltd., Japan. Preferably, the polyamide is included in a tie layer coating composition in an amount of less than about 10%, more preferably, less than about 7.5%, and even more preferably, less, than about 5% by weight.

Yet another preferred type of organic polymer for use in a tie layer in accordance with the present invention is a mixture of a polyvinyl acetal, preferably polyvinyl butyral, with a methylvinyl ether/maleic anhydride copolymer, in which the ratio of polyvinyl acetal to methylvinyl ether/maleic anhydride copolymer is preferably from about 5:1 to about 15:1 and, more preferably, about 12:1. Preferably, the mixture of a polyvinyl acetal with methylvinyl ether/maleic anhydride copolymer is included in a tie layer coating composition in an amount of less; than about 10%, more preferably, less than about 7.5%, and even more preferably, less than about 5% by weight. Optionally, a coupling agent can be included and is preferably selected from the group of glycidoxypropyltrimethoxysilane, vinyltrimethyoxysilane, chloromethyltrimethoxysilane, melhyltrimethoxysilane, and 3-aminopropyltriethoxysilane. If present, the coupling agent is typically present in an amount less than about 5% by weight of the tie layer coating composition.

A further preferred type of organic polymer for use in a tie layer in accordance with the present invention is a mixture of a polyvinyl acetal, preferably polyvinyl butyral, and a cross-linking agent, preferably, a bis aldehyde, more preferably, an aliphatic dialdehyde, and, even more preferably, glyoxal, such as that commercially available under the trade designation GLYOXAL 40, from Aldrich Chemical, Milwaukee, Wis. Preferably, the mixture of a polyvinyl acetal with a cross-linking agent is included in a tie layer coating composition in an amount of less than about 10%, more preferably, less than about 7.5%, and even more preferably, less than about 5% by weight.

Preferably, a tie layer coating composition also includes silica, preferably colloidal silica. Preferred colloidal silica compositions are commercially available under the trade designations SNOTEX O, from Nissan Chemical Industries, Ltd., Tarrytown, N.Y., and CABOSIL TS-720 from Cabot Corp., Tuscola, Ill. The tie layer coating composition preferably includes colloidal silica in an amount of about 0 to about 12% by weight.

In accordance with the present invention, a tie layer coating composition is applied to at least one surface on the organic photoconductor, such as on the surface of the charge generating layer, the surface of the barrier layer, or both. Regardless of the surface on which the tie layer coating composition is applied, the resulting tie layer preferably has a thickness of about 0.05 micrometer to about 0.7 micrometer.

Electrophotographic System

Organic photoreceptors described above are suitable for use in an imaging process with either dry or liquid toner development. Liquid toner development is generally preferred because it offers the advantages of providing higher resolution images and requiring lower energy for image fixing compared to dry toners. Examples of useful liquid toners are well known. They typically include a colorant (preferably a pigment), a resin binder, a charge director, and a carrier liquid. A preferred resin to colorant ratio is 2:1 to 10:1, more preferably 4:1 to 8:1. Typically, the colorant, resin, and the charge director form the toner particles.

Organic photoreceptors according to the invention are particularly useful in a compact electrophotographic imaging system where an organic photoreceptor in accordance with the present invention is wound around and supported by several rollers. A number of apparatus designs may be employed, including for example, the apparatus designs disclosed in U.S. Pat. Nos. 5,650,253 (Baker et al.); 5,659,851 (Moe et al.); and 5,916,718 (Kellie et al.).

Figure 2:
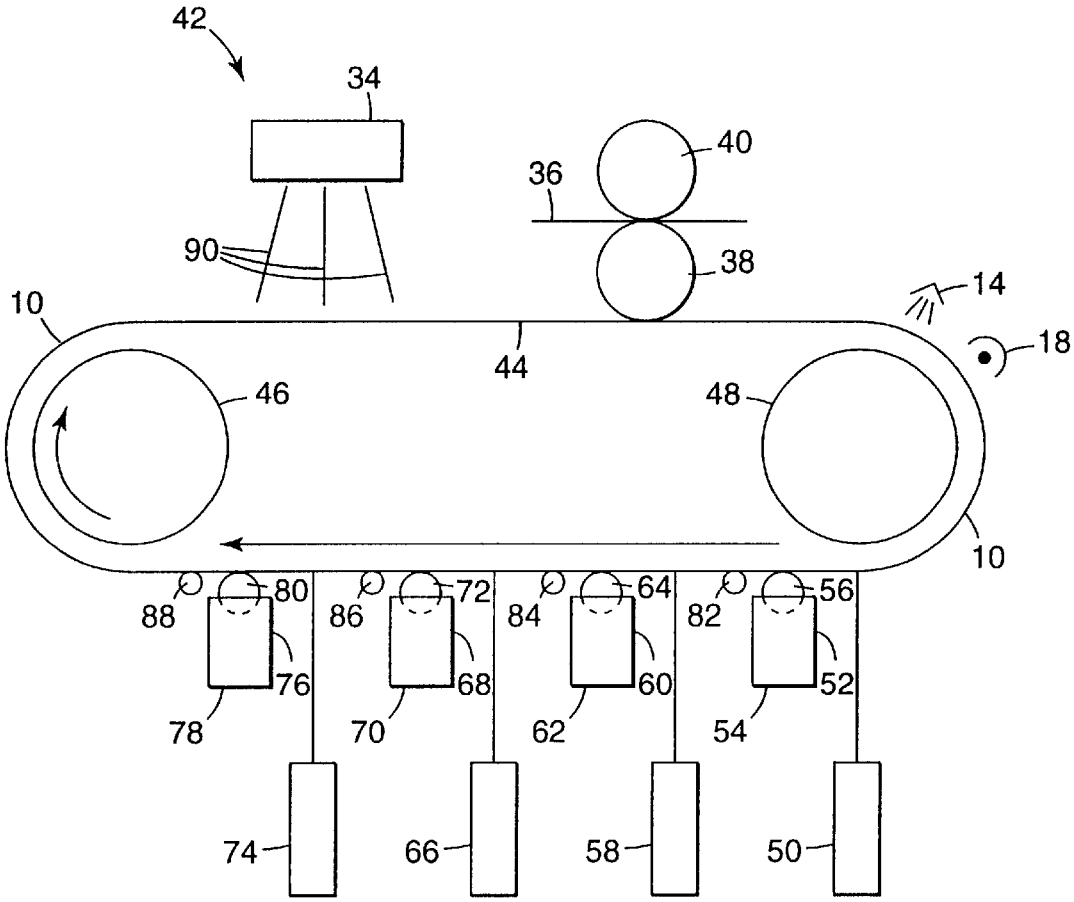
FIG. 2 is a schematic illustration of an electrophotographic system including an organic photoreceptor in accordance with the present invention, for producing multicolored images.

FIG. 2 is a schematic illustration of one preferred embodiment of an electrophotographic system 42 and a method for producing a multi-colored image utilizing an organic photoreceptor described above. An organic photoreceptor 10, preferably in the form of an endless belt, is mechanically supported by belt 44 that rotates, preferably in a clockwise direction, around rollers 46 and 48. The organic photoreceptor 10 may be first conventionally erased with an erase lamp 14. Preferably, any residual charge left on the organic photoreceptor 10 after the preceding cycle is removed by the erase lamp 14 and then conventionally charged using charging device 18 (e.g., a corona charging device), such procedures being well known in the art. When charged, a surface of the organic photoreceptor 10 is preferably charged from about 550 volts to about 750 volts. A laser scanning device 50 exposes the charged surface of the organic photoreceptor 10 to radiation in an image-wise pattern corresponding to a first color plane of the image to be reproduced. Suitable laser scanning devices are well known in the art.

Thereafter, charged pigment particles in a liquid toner 54, corresponding to the first color plane, will migrate to and plate upon the charged surface of the organic photoreceptor 10 in areas where the surface voltage of the organic photoreceptor 10 is less than the bias of electrode 56 associated with a liquid toner developer station 52. Charge neutrality of the liquid toner 54 is maintained by negatively charged counter ions that balance the positively charged pigment particles. The counter ions are deposited on the surface of the organic photoreceptor 10 in areas where the surface voltage is greater than the bias voltage of the electrode 56, such as that described in U.S. Pat. No. 5,596,398 (Woo et al.), associated with the liquid toner developer station 52. One example of a suitable developer station is described in U.S. Pat. No. 5,300,990 (Thompson et al.). Another developer apparatus is described in U.S. Pat. No. 5,758,236 (Teschendorf et al.).

At this stage, the organic photoreceptor 10 includes, on its surface, an image-wise distribution of plated "solids" of liquid toner 54 in accordance with the first color plane. The surface charge distribution of the organic photoreceptor 10 has also been recharged with plated ink particles as well as with transparent counter ions from the liquid toner 54, both being governed by the image-wise discharge of the organic photoreceptor 10 due to laser scanning device 50. Thus, the surface charge of the organic photoreceptor 10 is quite uniform. Although not all of the original surface charge of the organic photoreceptor may have been obtained, a substantial portion of the previous surface charge of the organic photoreceptor has been recaptured. With such solution recharging, the organic photoreceptor 10 can be processed for the next color plane of the image to be reproduced.

Although not required, a "topping corona" (not illustrated) may be applied to photoreceptor 10 following the first three or, optionally, all development stations 52, 60, 68 and 76, respectively. For example, while photoreceptor 10 recharges following development with liquid inks 54, 62 and 70, it typically does not recharge completely to the previously charged voltage. Thus, a conventional corona charging device may be employed following development stations 52, 60 and 68 to bring the voltage on photoreceptor 10 back to a preferred charging level. For example, following erasure by erase lamp 14, the surface of photoreceptor 10 is art a relatively low voltage level, typically around 100 volts. Following charging by a corona charging device (not shown), the surface of photoreceptor 10 is charged to a relatively high value suitable to development of a liquid ink, typically around 700 volts. Following image-wise exposure to radiation by laser scanning device 50, corresponding to a first color plane (preferably yellow), the areas of the surface of photoreceptor 10 are discharged to a discharged level of around 150 volts. Non-exposed areas of the surface of photoreceptor 10 remain at a highly charged level, around 700 volts. Following development by developer station 52, the surface of photoreceptor 10 is substantially uniformly charged to an intermediate level of around 500 volts. Discharged areas of photoreceptor 10 are developed "up" to 500 volts and non-discharged areas of photoreceptor 10 are developed "down" to 500 volts. Because this developed voltage will tend to decay over time, a topping corona is preferably used to bring the surface of photoreceptor 10 back up to the high level of around 700 volts.

As the belt 44 continues to rotate, the organic photoreceptor 10 next is image-wise exposed to radiation from laser scanning device 58 corresponding to a second color plane. Significantly, this process occurs during a single revolution of the organic photoreceptor by the belt 44 and without erasing the organic photoreceptor 10 subsequent to exposure to the laser scanning device 58 and the second liquid toner development station 60 corresponding to the first color plane. The remaining charge on the surface of the organic photoreceptor 10 is subjected to radiation corresponding to a second color plane. This produces an image-wise distribution of the surface charge on the organic photoreceptor 10 corresponding to the second color plane of the image.

The second color plane of the image is then developed by a developer station 60 containing a liquid toner 62. The liquid toner 62 preferably contains "solid" color pigments consistent with the second color plane and substantially transparent counter ions that, although they may have differing chemical compositions than the substantially transparent counter ions of the liquid toner 54, they are still substantially transparent and oppositely charged to the "solid" color pigments. The electrode 64 provides a bias voltage to allow "solid" color pigments of the liquid toner 62 to create a pattern of "solid" color pigments on the surface of the organic photoreceptor 10 corresponding to the second color plane. The transparent counter ions also substantially recharge the organic photoreceptor 10 and make the surface of the organic photoreceptor 10 substantially uniform so that another color plane may be placed upon the organic photoreceptor 10 without erasing or corona discharging.

A third color plane of the image to be reproduced is deposited on the surface of the photoreceptor 10 in a similar fashion using a laser scanning device 66 and a developer station 68 containing a liquid toner 70 using an electrode 72. Again, the surface voltage of the photoreceptor 10 may be somewhat less than existed prior to exposure to the laser scanning device 66 but will be substantially "recharged" and will be quite uniform allowing application of the fourth color plane without erasing or corona charging.

Similarly, a fourth color plane is deposited upon the photoreceptor 10 using a laser scanning device 74 and a developer station 76 containing a liquid toner 78 using an electrode 80.

Preferably, excess toner from the liquid toners 54, 62, 70, and 78 is "squeezed" off using a roller that may be used in conjunction with one or more of the developer stations 52, 60, 68, and 76, (shown as rollers 82, 84, 86, and 88, respectively, as described in U.S. Pat. No. 5,754,928 (Moe et al.)) to form plated solids from each of the liquid toners. The plated solids on the photoreceptor are then dried using a drying mechanism 34 to form a completed dry four color image. The drying mechanism 34 may utilize air blowers or may be other active devices such as drying rollers, vacuum devices, coronas, etc. One suitable drying mechanism is described in U.S. Pat. No. 5,420,675 (Thompson et al.).

The dry four color image is then preferably transferred, either directly to a medium 36 to be printed, or more preferably, indirectly by way of transfer mechanism 39, as shown in FIG. 2. Typically, heat and/or pressure are used to fix the image to the medium 36. Although the transfer mechanism 39 can take a variety of forms, one suitable transfer mechanism includes transfer rollers 38 and 40 and is described in U.S. Pat. No. 5,650,253 (Baker et al.).

With proper selection of charging voltages and liquid toners, the process may be repeated an indeterminate number of times to produce a multi-colored image having an indeterminate number of color planes. Although the process and apparatus has been described in connection with four color images, one skilled in the art will appreciate that the present invention is suitable for multi-color images hating two or more color planes.

The following examples are illustrative of specific embodiments and/or methods according to the present invention. A wide variety of variations from the following examples are within the scope of the present invention and are only to be limited by the appended claims.

EXAMPLES

Preparation of barrier laver coating compositions:

For Examples 1–34

All coating solutions were made containing 1–2% total solids.

A 3% by weight stock solution of methyl cellulose, commercially available under the trade designation METHOCEL A15LV, from Dow Chemical, Midland, Mich., was made in water. The water was heated to about 90° C. The methyl cellulose powder was then added under agitation. The solution was then cooled to about 4° C. using an ice bath, and agitated using an air mixer for about 20 minutes at 4° C. The solution was then allowed to sit and reach ambient temperature.

A 3% stock solution of methylvinylether/maleic anhydride copolymer, commercially available under the trade designation GANTREZ AN-169, from ISP Chemical, Wayne, N.J., was made in water. The copolymer was added under agitation and the water was then brought up to about 90° C. The solution was agitated at 90° C. until the solution became clear. This took about 40 minutes.

The appropriate ratio (by weight) of each stock solution was combined in an empty container. The ratios ranged from 80/20 to 20/80 for Examples 1–5 below. A nonionic surfactant, commercially available under the trade designation TRITON X100, from Aldrich Chemical, Milwaukee, Wis., was then added at a ratio of 0.02 g/100 g of water. The solution was then diluted with methanol. A dialdehyde cross-linker, commercially available under the trade designation GLYOXAL 40, from Aldrich Chemical, Milwaukee, Wis., was then added in an amount between 1–10% of the total solids by weight of the sum of the cellulosic resin and the copolymer, in Examples 7–12 below.

Additionally, a coating composition was prepared, as generally described in International Publication No. WO 95.02853 (Woo et al.). In accordance with the teachings therein, the following coating composition was prepared.

| Final % in Solution | Compouud |
|---|---|
| 20.18 | Polyvinyl Butyral (6% PVB(BX-5) in Methanol) |
| 3.13 | Colloidal silica (30% Nalco 1057 in 2,2 propoxyethanol/Water) |
| 61.55 | Isopropyl alcohol |
| 3.07 | Glycidoxypropyltrimethoxysilane (GPS) (5% GPS in 50/50 IPA/Water) |
| 12.07 | Poly(methyl vinyl ether/maleic anhydride) copolymer (1.5% GANTREZ AN-169 in Methanol/Water) |

GPS was added to a 50:50 IPA/water solution in an amount of 5%. The resulting mixture was allowed to sit at room temperature for at least one hour. The copolymer (poly(methyl vinyl ether/maleic anhydride)) was added to a 75:25 methanol/water solution in an amount of 1.5% and agitated at room temperature until the solution was clear, typically from about 1 to about 8 hours of agitation. The, polyvinyl butyral was added to methanol in an amount of 6% and agitated at room temperature until the solution was clear, typically from about 1 to about 8 hours. Once these solutions were made, they were combined along with the colloidal silica and the IPA at room temperature in the amounts specified in the chart above to form a coating composition. No specific order of addition was needed. The resulting coating composition is abbreviated "PSG" throughout the examples.

Application of barrier layer coating compositions on to a photoconductor:

An inverted dual layer organic photoconductor (herein, "OPC") was prepared utilizing compound (2) as described in U.S. patent application Ser. No. 09/172,379, filed Oct. 14, 1998, now U.S. Pat. No. 6,066,426, entitled "Organophotoreceptors for Electrophotography Featuring Novel Charge Transport Compounds" (Mott et al.) was used as the substrate, that included a polyester layer, an aluminum layer, a PET layer (formed from a resin commercially available under the trade designation VITEL PE 2200, from Bostik Chemicals, Middleton, Mass., at a 4.4% solids in a 2:1 MEK:toluene mixture, coated at a thickness of 0.2 micrometers using a slot die coater with a web speed of 3.048 meters/min., dried in 4 oven zones of 110° C., 120° C., 140° C., and 150° C.), a charge transport layer, and a charge generating layer. A barrier layer coating composition was then coated over the charge generating layer at a thickness ranging from 0.2–0.8 micrometers. The web was run at 10 feet (3.048 m) per minute, through 20 feet (6.096 m) of oven. The barrier layer coating compositions described above were applied using a conventional slot die coater. The coated OPC was passed through 4 oven zones set at 90° C., 100° C., 110° C., and 120° C. to dry the barrier layer coating composition, forming the barrier layer. Once the barrier layer was formed on the OPC, it is referred to herein as an OPR (organic photoreceptor).

The barrier layer coating composition in Comparative Examples C, J, and N was coated on the substrate at 1.5% solids with a 4 mil (102 micrometer) shim and a 5 micron filter at a web speed of 3.048 m/min. The coated OPC was passed through 4 oven zones set at 90° C., 100° C., 110° C., and 110° C. to dry the barrier layer coating composition, forming the barrier layer.

Testing of OPR Examples and Comparative Examples:

1. Dynamic Carrier Liquid Crazing Resistance:

A 7.62 cm×22.86 cm sample of each OPR Example/Comparative Example was mounted on a flexure fatigue tester that applies 50 lbs (24.7 kg) tensile load on the sample. A sufficient amount of a paraffinic hydrocarbon solvent commercially available under the trade designation NORPAR 12, from Exxon Corp., Houston Tex., was then spread onto the surface, and six rollers of 2.54 cm diameter continuously deflect the sample from the back side. After 4 hours (which is believed to be equivalent to 10,000 cycles in a belt printing mechanism), the sample is released and visibly examined for any sign of crazing.

2. Static Solvent Crazing Resistance:

A cylindrical sample (30.cm long×30 cm circumference) of each OPR Example/Comparative Example was mounted on a staltic load tester, which employs a 1.27 cm and 1.91 cm diameter metal bar on either end of the frame to stretch the sample with 36 lbs (16.33 kg) of force. A sufficient amount of the NORPAR solvent was spread on the coated surface. After 10 minutes, the sample was released, allowed to dry, and visibly examined for signs of crazing according to the subjective standard: a rating of 1 indicated no crazing present, 1.5 indicated very, very light crazing was present, 2 indicated very light crazing, and so on to an upper score of 8 that indicated very heavy crazing. A value more than about 3 was considered an unacceptable to be useful in an electrophotographic process.

3. Adhesion to CGL layer:

Two 30.48 cm×30.48 cm samples of each OPR Example/Comparative Example were cut. A piece of book tape was then stuck onto one sample and rubbed with the thumb. The tape is then pulled back sharply at about 180 degrees. The surface was then visually examined for delamination.

The second sample cut from each Example/Comparative Example was soaked in the carrier liquid overnight at room temperature, dried, and then a piece of book tape was then stuck onto one sample and rubbed with the thumb. The tape is then pulled back sharply at about 180 degrees. The surface was again visually examined for delamination.

4. Dry Electrostatic Performance:

Three belts, each measuring 50 cm long by 8.8 cm wide, were fastened side-by-side and completely around an aluminum drum (50 cm circumference). The drum rotated at a rate of 7.6 cm/min and the erase, corona charging, laser discharge, stations are located at 20°, 35°, and 45° positions, respectively, from the top of the drum. The first electrostatic probe (Trek 344 electrostatic meter, from Trek Inc., Medina N.Y.) is located immediately after the laser discharge stations and the second probe at 180° from the top of the drum. These measurements were performed at room temperature (25° C.).

Electrostatic measurements were obtained from the following sequence of test subroutines:

1) PRODSTART: This test was designed to evaluate the electrostatic cycling of a new, fresh belt. The belt was completely charged for three cycles (drum rotations); discharged with the laser at 780 nm, 600 dpi on the forth cycle; completely charged for the next three cycles; discharged with only the erase lamp at 720 nm on the eighth cycle; and, finally, completely charged for the last three cycles.

2) VLOGE: This test measured the response of the photoconductor to various irradiation levels (0.01 mW to 3 mW) by monitoring the discharge voltage of the bell; as a function of the laser power. A semi-logarithmic plot was generated (voltage verses log E) when the belt is charged and then discharged using the laser at different power levels.

3) DARK DECAY: This test measured the loss of charge acceptance with time without laser or erase illumination and can be used as an indicator of i) the injection of residual holes from the charge generation layer to the charge transport layer, ii) the thermal liberation of trapped charges, and iii) the injection of charge from the surface or aluminum ground plane. After the belt was completely charged, it was stopped under the probe near the laser discharge station, and the surface voltage level was measured over a period of 90 seconds. The decay in the initial voltage was plotted verses time.

4) LONGRUN: The belt was electrostatically cycled, according to the following sequence for each belt-drum revolution, for 4,000 drum revolutions: the belt was charged by the corona, the laser was cycled on and off to discharge a portion of the belt, and, finally, the erase lamp discharged the whole belt in preparation for the next cycle. The laser was cycled so that the first 16.7 cm of the belt was never exposed, the following 8 cm section was exposed, then 4 cm was unexposed, the next 8 cm section was exposed, and finally the last 12.5 cm was unexposed. This pattern was repeated for 4,000 drum revolutions and the data was collected during the first cycle and then after each 200th drum revolution.

5) After the 4,000th cycle (long run test), the PRODSTART (now called PRODEND), VLOGE, DARK DECAY tests were run again.

5. Wet Electrostatic Performance: A 29.12 cm×96.52 cm sample of each OPR Example/Comparative Example was welded into a belt form and mounted into a mechanism having charge-discharge capabilities, an erase bar, and a steering mechanism designed to guide the OPR belt. It was run for 4,000 cycles or more. The coated surface of the sample is continuously applied with the carrier liquid during the course of the run, and the sample is checked periodically for crazing. Electrostatic data was collected from three probes following the corona charging, laser discharging, and erase stations.

6. Adhesion to Release Layer: Wiping Test (i.e., Peel Force Test): OPR samples which have been coated with a top release layer were cut into six 3.175 cm wide X 10.16 cm long pieces cut in the coating direction of the OPR material. Three of the six pieces were mounted with silicone tape onto weighted shoes on a drum wiping mech. The release-coated surface of the samples was wiped with the carrier liquid soaked paper toweling (Kleenex Premiere brand from Kimberly Clark, Neenah, Wis.) for 800 rotational cycles. The paper toweling was then replaced with the carrier liquid soaked paper toweling prepared in the same manner, and the process is repeated three times for a total of 3200 cycles. The three finished samples were allowed to dry overnight. Meanwhile, the three initial, unwiped samples were tested for 180-degree peel force/adhesion using a slip/peel force tester from Instrumentors, Inc. Once the three wiped samples dried, they were also tested for peel force/adhesion in the same manner, and the results were compared to the values of the unwiped samples. All samples were tested with tape commercially available under the trade designations #202 and #600, both from Minnesota Mining and Manufacturing Company, St. Paul, Minn.

Results

A series of different ratios of components in the barrier layer coating composition were coated and evaluated for crazing and adhesion to the charge generation layer (herein, CGL) of the OPC. These results are shown in Table 1.

An aliphatic dialdehyde cross-linker commercially available under the trade designation GLYOXAL 40, from Aldrich Chemical, Milwaukee, Wis., was added to the barrier layer coating composition and the adhesion results are shown in Table 2.

Table 3 shows electrostatic data for OPR including a barrier layer, in accordance with the present invention.

TABLE 1

Comparison of different binder ratios for crazing tests Examples 1–6 and Comparative Examples A–C

| Ex. | Methyl cellulose | Methyl-vinyl ether/ maleic anhydride copolymer | Adhesion to CGL* | Static crazing on 1.27 cm bar** | Static crazing on 1.903 cm bar** | Dynamic Crazing |
|---|---|---|---|---|---|---|
| A | 100 | 0 | Poor | 2 | 1 | 1 |
| 1 | 80 | 20 | Poor | 1.5 | 1 | 1 |
| 2 | 60 | 40 | Poor | 1 | 1 | 1 |
| 3 | 50 | 50 | Poor | 1 | 1 | 1 |
| 4 | 40 | 60 | Some | 1.5 | 1 | 1 |
| 5 | 20 | 80 | Good | 2 | 1.5 | 1 |
| 6 | 0 | 100 | Good | 2 | 1.5 | 1 |
| B | 0 | 0 | N/A | 8 | 8 | 8 |
| C | PSG | PSG | Good | 6 | 7 | 5 |

*A rating of poor = total delamination of barrier from CGL, some = about ½ of the barrier delaminated, and ½ stayed on the OPC, and good = little if any delamination

**A rating of 1 = no crazing, 1.5 = very, very light crazing, 2 = very light crazing, up to 8 = very heavy crazing Based on the crazing results, Examples 1, 2, 3, and 4 were considered acceptable, each having a rating less than 2. Examples 2 and 3 were considered mo-re preferable. Accordingly, based on the results above, preferred ratios of cellulose resin to copolymer were 1:0.25 to 1:1.5, with particularly preferred ratios from 1:0.67 to 1:1.

Table 2

Comparison of different amounts of cross-linking agent for adhesion to CGL

TABLE 2

Comparison of different amounts of cross-linking agent for adhesion to CGL Examples 7–12

| Ex. | Ratio of binders | % bis aldehyde cross-linker* | Adhesion to CGL** |
|---|---|---|---|
| 7 | 50/50 | 0 | Poor |
| 8 | 50/50 | 1 | Some |
| 9 | 50/50 | 2.5 | Some |
| 10 | 50/50 | 5 | Good |
| 11 | 50/50 | 7.5 | Good |
| 12 | 50/50 | 10 | Good |

*by % solids by weight of the sum amount of the resin and the copolymer

**A rating of poor = total delamination of barrier from CGL, some = about ½ of the barrier delaminated, and ½ stayed on the OPC, and good = little if any delamination Based on the adhesion results in which a rating of "good" was desired, a preferred percent of the bis aldehyde cross-linker was from 1 to 10% and 5 to 10% being more preferred.

TABLE 3

Electrostatic data of different binder ratios and levels of cross-linking Examples 13–21 and Comparative Example D

| Ex. | Methyl cellulose | Methylvinyl ether/maleic anhydride copolymer | % cross-linker | V acc (V)[1] | Δ(V) | Discharge (V)[2] | Δ(V) | Dark Decay (at 4000th cycle) |
|---|---|---|---|---|---|---|---|---|
| D | 100 | 0 | 0 | 660–700 | 40 | 25–50 | 25 | 80 |
| 13 | 80 | 20 | 0 | 700–660 | 40 | 25–40 | 15 | 90 |
| 14 | 60 | 40 | 0 | 665–640 | 25 | 25–40 | 15 | 100 |
| 15 | 50 | 50 | 0 | 630–600 | 30 | 25–25 | 0 | 125 |
| 16 | 40 | 60 | 0 | 670–660 | 10 | 25–40 | 15 | 110 |
| 17 | 20 | 80 | 0 | 610–600 | 10 | 25–35 | 10 | 75 |
| 18 | 0 | 100 | 0 | 640–540 | 100 | 25–35 | 10 | 75 |
| 19 | 50 | 50 | 1 | 630–600 | 30 | 25–25 | 0 | 70 |
| 20 | 50 | 50 | 5 | 620–610 | 10 | 20–20 | 0 | 75 |
| 21 | 50 | 50 | 10 | 490–480 | 10 | 15–15 | 0 | 200 |

[1,2]Each Example was subjected to 4000 charge-discharge cycles. For each Example, the first value in the column labeled "V acc (V)" represents the initial charge, or charge acceptance, at cycle 1 and the second value in that column represents the initial charge at cycle 4000. Similarly, for each Example, the first value in the column labeled "Discharge (V)" represents the discharged voltage at cycle 1 while the second value in that same columnrepresents the discharged voltage at cycle 4000.

In this evaluation, a high charge acceptance value and a low discharge value with low delta values and low dark decay values are a desired combination. For the delta values, a value of less than 40 was considered an acceptable value, with less than 20 being particularly desirable. A charge acceptance (V acc) value of more than about 600 V was preferred. A discharge value of less than about 50 V was preferred. Additionally, a dark decay value of less than 100 V was preferred.

In the Examples above, Examples 18 and 21 were considered to be less acceptable than other examples. In Example 18, the delta value was too high. Example 21 exhibited a high dark decay value and a low charge acceptance (V acc) value. Coupled with the results shown in Tables 1 and 2, Example 20 appears to exhibit superior barrier properties.

Examples 22–25 and Comparative Examples E–J

In order to enhance adhesion of the barrier layer to the release layer, different organic film-forming polymer compositions were evaluated as a tie layer between the release layer and the barrier layer. The compositions for the tie layers in each of the examples tested are show in the chart below:

| Example | Tie Layer Coating Composition |
|---|---|
| Comparative Example E | No tie layer |
| Example 22 | PSG |
| Comparative Example F | 4.4% Polyester resin |
| | 63.7% Methylethyl ketone |
| | 31.8% Toluene |
| Example 23 | 3.5% Nylon copolymer (ULTRAMID, from BASF Corp.) |
| | 80% Methanol |
| | 16.5% Water |
| Example 24 | 3% poly(hydroxy amino ether) (XUR, Dow Chemical) |
| | 91% tetrahydrofuran |
| | 6% Dimethyl formamide |
| Comparative Example G | 5% Glycidoxypropyltrimethoxysilane |
| | 95% Water |

-continued

| Example | Tie Layer Coating Composition |
|---|---|
| Comparative Example H | 98% 1-methoxy 2-propanol |
| | 1.5% BX-5 (polyvinyl butyral) |
| | 0.47% Isocyanate |
| | 0.45% Fumed silica (Cab-O-Sil TS-720) |
| Example 25 | 98% 1-methoxy 2-propanol |
| | 1.5% BX-5 (polyvinyl butyral) |
| | 0.45% Fumed silica (Cab-O-Sil TS-720) |
| | 0.188% Glyoxal 40 (40% in water) |
| Comparative Example I | 98% 1-methoxy 2-propanol |
| | 1.5% BX-5 (polyvinyl butyral) |
| | 0.45% Fumed silica (Cab-O-Sil TS-720) |
| | 0.188% aziridine crosslinker (PFAZ-322, Sybron Chemicals, Inc., Birmingham, NJ |
| Comparative Example J | No tie layer |

Each tie layer coating composition from above was coated on a substrate including a barrier layer with a slot die coater at a web speed of 3.048 m/min. The coated OPC was passed through 4 oven zones set at 90° C., 110° C., 120° C., and 140° C. to dry the tie layer coating composition, forming the tie layer.

Adhesion between a release layer and each of the tie layers above was evaluated in terms of the peel force (described above) and the results are listed in Table 4.

TABLE 4

Peel force data of various barrier/tie layer systems coated with release

| Ex. | Barrier Layer | Tie layer | Peel force after wiping (#202 tape), g/2.54 cm |
|---|---|---|---|
| Comp. Ex. E | MC/MA* | None | Delaminated |
| 22 | MC/MA* | PVB/silica/silane | 55.6 |
| Comp. Ex. F | MC/MA* | Polyester resin | 864 |
| 23 | MC/MA* | Nylon copolymer | 122 |
| 24 | MC/MA* | poly(hydroxy amino ether) | 10.7 |

TABLE 4-continued

Peel force data of various barrier/tie layer systems coated with release

| Ex. | Barrier Layer | Tie layer | Peel force after wiping (#202 tape), g/2.54 cm |
|---|---|---|---|
| Comp. Ex. G | MC/MA* | silane coupling agent | 868 |
| Comp. Ex. H | MC/MA* | Isocyanate/PVB | 455 |
| 25 | MC/MA* | PVB cross-linked with glyoxyl | 92 |
| Comp. Ex. I | MC/MA* | PVB cross-linked with aziridine crosslinker | 298 |
| Comp. Ex. J | PSG | None | 19.8 |

*barrier system was 50/50 methyl cellulose/(methylvinylether/maleic anhydride) copolymer + 5% aliphatic dialdehyde cross-linker A peel force of less than 100 g/2.54 cm was desirable, with 50 g/2.54 cm being more preferred. Delamination of any example was considered unacceptable.

The following represents evaluations to determine the effect of thickness in the performance of the barrier layer and the tie layer. The results of the electrostatic data are shown in Table 5, and the peel force data are shown in Table 6.

Examples 26–34 and Comparative Examples K–N

In the following examples, a release layer was added to the construction and was layered over the tie layer. The release layer was formed from a release layer coating composition as follows:

| | |
|---|---|
| 6.4% | vinyl methyl siloxane-dimethyl siloxane copolymer (trade designation VDT-731, from Gelest), |
| 0.06% | Fumed Silica (trade designation Cab-O-Sil TS-720) |
| 0.87% | vinyl dimethylsiloxy terminated polydimethylsiloxane (trade designation DMS-V41, from Gelest), 15% in heptane |
| 0.16% | catalyst, trade designation DC 4000, from Dow Corning |
| 0.16% | Diethyl fumarate/Benzyl alcohol (in a 50:50 ratio) |
| 90.26% | Heptane |
| 2.15% | crosslinker, trade designation DC-7048, from Dow Corning |

The release layer coating composition from above was coated on a substrate including a barrier layer and a tie layer with a slot die coater at a thickness of 0.65 micrometers at a web speed of 6.096 m/min. The coated OPC was passed through 4 oven zones all set at 150° C. to dry the release layer coating composition, forming the release layer.

TABLE 5

Electrostatic data for various thickness (in micrometers) of barrier/tie/release systems

| Ex. | Barrier layer thick-ness | Tie Layer thick-ness | Release layer thick-ness | V acc (V)[1] | Δ(V) | Discharge (V)[2] | Dark decay (V) (at 4000th cycle) |
|---|---|---|---|---|---|---|---|
| 26 | 0.4 | 0.2 | 0.65 | 585–520 | 65 | 40–40 | 40 |
| K | 0.8 | 0.2 | 0.65 | 600–480 | 120 | 130–120 | 40 |
| 27 | 0.4 | 0.6 | 0.65 | 660–585 | 75 | 65–85 | 40 |
| 28 | 0.8 | 0.6 | 0.65 | 660–540 | 120 | 100–120 | 60 |
| L | 0.6 | 0.4 | 0.65 | 480–420 | 60 | 95–95 | 20 |
| 29 | 0.32 | 0.4 | 0.65 | 680–640 | 40 | 80–80 | 30 |
| M | 0.88 | 0.4 | 0.65 | 560–500 | 60 | 80–80 | 50 |
| 30 | 0.6 | 0.12 | 0.65 | 620–530 | 90. | 100–100 | 40 |

TABLE 5-continued

Electrostatic data for various thickness (in micrometers) of barrier/tie/release systems

| Ex. | Barrier layer thick-ness | Tie Layer thick-ness | Release layer thick-ness | V acc (V)[1] | Δ(V) | Discharge (V)[2] | Dark decay (V) (at 4000th cycle) |
|---|---|---|---|---|---|---|---|
| 31 | 0.6 | 0.66 | 0.65 | 650–570 | 80 | 110–120 | 30 |
| 32 | 0.6 | 0.4 | 0.65 | 620–540 | 80 | 85–100 | 50 |
| 33 | 0.6 | 0.4 | 0.32 | 640–560 | 80 | 95–110 | 40 |
| 34 | 0.6 | 0.4 | 0.97 | 640–600 | 40 | 140–140 | 50 |
| N | 0698A-8 | PSG | 0.65 | 720–560 | 160 | 160–140 | 80 |

*All barrier layers were 50/50 methyl cellulose/(methylvinylether/maleic anhydride) copolymer + 5% aliphatic dialdehyde cross-linker
**Tie layers were poly(hydroxy amino ether), as in Example 24-above
[1,2]Each Example was subjected to 4000 charge-discharge cycles. For each Example, the first value in the column labeled "V acc (V)" represents the initial charge, or charge acceptance, at cycle 1 and the second value in that column represents the initial charge at cycle 4000. Similarly, for each Example, the first value in the column labeled "Discharge (V)" represents the discharged voltage at cycle 1 while the second value in that same column represents the discharged voltage at cycle 4000.

In evaluating the Examples from above, the following parameters were considered acceptable: a delta V less than 100V, a charge up value more than 50()V, a discharge value less than 100V, and a dark decay value less than 500V.

Example 26 exhibited the lowest discharge value and also exhibited a low dark decay value, a low delta V, and acceptable charge acceptance levels.

TABLE 6

Peel force data for various thickness (in micrometers) in barrier/tie/release layers

| Ex. | Barrier layer thick-ness* | Tie layer thick-ness** | Release layer thickness | Peel force before wiping (202 tape), g/2.54 cm | Peel force after wiping (202 tape), g/2.54 cm |
|---|---|---|---|---|---|
| 26 | 0.4 | 0.2 | 0.65 | 5.3 | 17.2 |
| K | 0.8 | 0.2 | 0.65 | 5.5 | 34.2 |
| 27 | 0.4 | 0.6 | 0.65 | 3.1 | 14.4 |
| 28 | 0.8 | 0.6 | 0.65 | 3.6 | 22.1 |
| L | 0.6 | 0.4 | 0.65 | 4.2 | 13.7 |
| 29 | 0.32 | 0.4 | 0.65 | 4 | 18.1 |
| M | 0.88 | 0.4 | 0.65 | 4.6 | 14.3 |
| 30 | 0.6 | 0.12 | 0.65 | 5.1 | 11.1 |
| 31 | 0.6 | 0.66 | 0.65 | 2.7 | 13.6 |
| 32 | 0.6 | 0.4 | 0.65 | 5.2 | 19.7 |
| 33 | 0.6 | 0.4 | 0.32 | 3.6 | 15.2 |
| 34 | 0.6 | 0.4 | 0.97 | 5.6 | 16.4 |
| N | 0598B | PSG | 0.65 | 8 | 35.4 |

*All barrier layers are 50/50 methyl cellulose/(methylvinylether/maleic anhydride) copolymer + 5% aliphatic dialdehyde cross-linker
**All tie layer systems are poly(hydroxy amino ether), as in Example 24 above In evaluating the results in the table above, a peel force less than 50 g/2.54 cm is preferred. All Examples were found to be acceptable.

In conclusion, an improved barrier layer for an electrophotographic process is provided. The barrier layer containing methyl cellulose, methylvinyl ether/maleic anhydride copolymer, and crosslinker provided an excellent barrier layer to prevent the OPC from solvent and stress induced crazing. It also provided good electrostatic charging-discharge properties and excellent adhesion to the CGL. Additionally, as demonstrated above, adhesion of a barrier layer to the release layer can be further improved with the addition of a tie layer.

Examples 35–37 and Comparative Example P

The following Examples illustrate an organic photoreceptor that includes a barrier layer formed from a barrier layer coating composition that includes a cellulosic resin, a methylvinyl ether/maleic anhydride copolymer, and a polyamide. Specifically, the polyamide commercially available under the trade designation ULTRAMID IC (from BASF Corporation), the methylvinyl ether/maleic anhydride copolymer commercially available under the trade designation GANTREZ AN-169 (from ISP Chemical) and the cellulosic resin commercially available under the trade designation METHOCEL A15LV(from Dow Chemical) were combined to form a barrier layer coating composition.

All coating solutions were made containing 2–4 wt% total solids.

A 10 wt% aqueous solution of methyl cellulose was prepared by heating the water to about 90° C. and slowly adding the methyl cellulose powder under agitation. The solution was then cooled to about 4° C. using an ice bath and agitated using an air mixer for about 20 minutes at 4° C. The solution was allowed to sit, reach room temperature, and then it was diluted to 2.4 wt% solids with n-propanol to make the working stock solution.

A 25 wt% aqueous solution of the methylvinylether/maleic anhydride copolymer was prepared by heating the water to about 90° C. and slowly adding the copolymer under agitation. The solution was agitated at 90° C. until the mixture became clear, circa 40 minutes. The solution was allowed to sit, reach room temperature, and then it was diluted to 16.4 wt% solids with n-propanol to make the working stock solution.

A 20 wt% working stock solution of the polyamide was prepared by heating a n-propanol:ethanol:methanol:water (50:23:23:4) solvent mixture to 40° C. and slowly adding the polyamide under agitation. The solution was agitated at 40° C. until the mixture became clear and then allowed to cool to room temperature.

The barrier layer coating composition was die coated using a conventional slot die coater on an IDL, as described above in Example 1. The web was run at 10 feet (3.048 m) per minute, through a 20 ft (6.096 m) oven and passed through 4 oven zones set at 100° C., 110° C., 120° C., and 130° C. to dry the barrier layer coating composition, forming the barrier layer. The resulting barrier layer had a dry thickness of 0.4 to 0.5 micrometers (about 10–40 micrometers wet thickness at 3% total solids).

TABLE 7

Barrier Layer Coating Composition and Example Construction

| Example | Polyamide | Methylvinyl ether/maleic anhydride | Methyl Cellulose | Dry Barrier Layer Thickness (um) | Release Layer* |
|---|---|---|---|---|---|
| 35 | 12.5 | 12.5 | 75 | 0.4 | Yes |
| 36 | 25 | 0 | 75 | 0.4 | Yes |
| 37 | 33 | 17 | 50 | 0.4 | Yes |
| Comp. Ex. P | 100 | 0 | 0 | 0.5 | Yes |

*Release layer formed from a release layer coating composition as described in Examples 26–34, above.

Each Example was evaluated by measuring their physical and electrostatic cycling properties using the Static Solvent Crazing Resistance test and Dry Electrostatics Test, each as described above. The data is shown in Table 8.

TABLE 8

Electrostatic data

| Ex. | V acc (V)[1] | Δ(V) | Discharge(V)[2] | Δ(V) | Dark Decay |
|---|---|---|---|---|---|
| 35 | 627–621 | −6 | 100–142 | 42 | 44 |
| 36 | 656–637 | −19 | 121–166 | 45 | 50 |
| 37 | 637–647 | 10 | 109–152 | 43 | 59 |
| Comp. Ex. P | 676–642 | −34 | 160–207 | 47 | 57 |

[1,2]Each Example was subjected to 4000 charge-discharge cycles. For each Example, the first value in the column labeled "V acc (V)" represents the initial charge, or charge acceptance, at cycle 1 and the second value in that column represents the initial charge at cycle 4000. Similarly, for each Example, the first value in the column labeled "Discharge (V)" representsthe discharged voltage at cycle 1 while the second value in that same column represents the discharged voltage at cycle 4000.

Discharge voltage levels for full construction belts (OPR coated through the release layer) that were lower than 170 V were considered ideal, as demonstrated by Examples 35–37. Based on the evaluations herein, Examples 35–37 displayed a low discharge voltage and also had good crazing resistance. These Examples indicated that a composition that contained a relatively large amount of cellulose resin (greater than 50%), a moderate amount of polyamide (between 12% and 33%) and a relatively low amount of copolymer (less than 17%) yielded a single layer barrier than had good electrostatic properties, good adhesion to the CGL (i.e., exhibited a tie layer function) and release layers, and did not severely craze.

All patents, patent applications, and publications disclosed herein are incorporated by reference in their entirety, as if individually incorporated. The foregoing detailed description and examples have been given for clarity of understanding only. No unnecessary limitations are to be understood therefrom. The invention is not limited to the details shown and described, for variations obvious to one skilled in the art will be included within the invention defined by the claims.

What is claimed is:

1. An organic photoreceptor comprising:

an organic photoconductor having a first major surface and a second major surface;

a barrier layer on the first major surface of the photoconductor formed from a barrier layer coating composition comprising a cellulosic resin, a methylvinylether/maleic anhydride copolymer, and a crosslinking agent; and a release layer.

2. The organic photoreceptor of claim 1, wherein the cellulosic resin is selected from the group of a modified methyl cellulose, an unmodified methyl cellulose, and a combination thereof.

3. The organic photoreceptor of claim 1, wherein the crosslinking agent is a bis aldehyde.

4. The organic photoreceptor of claim 3, wherein the cross-linking agent is glyoxal.

5. The organic photoreceptor of claim 1, wherein the barrier layer coating composition comprises the cellulosic resin in an amount from about 0.2% solids by weight to about 15.0% solids by weight.

6. The organic photoreceptor of claim 1, wherein the barrier layer coating composition comprises the cellulosic resin in an amount of 0.6% solids by weight to about 2.5% solids by weight.

7. The organic photoreceptor of claim 1, wherein the barrier layer coating composition comprises the cellulosic resin in an amount of 0.75% solids by weight.

8. The organic photoreceptor of claim 1, wherein the barrier layer coating composition comprises the copolymer in an amount of about 1.2% solids by weight to about 0.3% solids by weight.

9. The organic photoreceptor of claim 1, wherein the barrier layer coating composition comprises the copolymer in an amount of about 0.9% solids by weight to about 0.6% solids by weight.

10. The organic photoreceptor of claim 1, wherein the barrier layer coating composition comprises the copolymer in an amount of about 0.75% solids by weight.

11. The organic photoreceptor of claim 1, wherein the barrier layer coating composition comprises a ratio of the cellulosic resin to the copolymer of about 0.4:1.0 to about 1.0:0.4.

12. The organic photoreceptor of claim 1, wherein the barrier layer coating composition comprises a ratio of the cellulosic resin to the copolymer of about 1:1.

13. The organic photoreceptor of claim 1, wherein the barrier layer coating composition comprises the cellulosic resin in an amount of about 0.75% solids by weight of the cellulose resin and the copolymer in an amount of about 0.75% solids by weight of the copolymer.

14. The organic photoreceptor of claim 1, wherein the barrier layer coating composition comprises the cross-linking agent in an amount from about 1.0% solids by weight to about 10.0% solids by weight of the sum amount of the resin and the copolymer in the barrier layer coating composition.

15. The organic photoreceptor of claim 1, wherein the barrier layer coating composition comprises the cross-linking agent in an amount from about 1.0% solids by weight to about 7.5% solids by weight of the sum amount of the resin and the copolymer in the barrier layer coating composition.

16. The organic photoreceptor of claim 1, wherein the barrier layer coating composition further comprises a non-ionic surfactant.

17. The organic photoreceptor of claim 1, wherein the barrier layer has a thickness of about 0.2 micrometers to about 1.0 micrometers.

18. The organic photoreceptor of claim 1, wherein the organic photoreceptor is in a form of a flexible belt.

19. The organic photoreceptor of claim 1, further comprising a tie layer, wherein the tie layer is positioned between the barrier layer and the release layer.

20. The organic photoreceptor of claim 19, wherein the tie layer is formed from a tie layer coating composition comprising a polyetheramine having aromatic ether and amine repeating units in its backbone and pendant hydroxyl moieties.

21. The organic photoreceptor of claim 19, wherein the tie layer is formed from a tie layer coating composition comprising a polyamide.

22. The organic photoreceptor of claim 19, wherein the tie layer is formed from a composition comprising a polyvinyl acetal and a methylvinyl ether/maleic anhydride copolymer.

23. The organic photoreceptor of claim 19, wherein the tie layer is formed from a composition comprising a polyvinyl acetal, methylvinyl ether/maleic anhydride copolymer, and a crosslinking agent.

24. An electrophotographic system for producing a multicolored image comprising:

an photoreceptor comprising:

an organic photoconductor having a first major surface and a second major surface;

a barrier layer on the first major surface of the photoconductor formed form a barrier layer coating composition comprising a cellulosic resin, a methylvinylether/maleic anhydride copolymer, and a crosslinking agent; and a release layer;

a positioner for movably positioning the photoreceptor in order that a given portion of the photoreceptor sequentially advances through a plurality of locations in a single pass;

an eraser for erasing any previously accumulated charge from the photoreceptor;

a charger for charging the photoreceptor to a predetermined charge level;

at least one image-wise exposing device for exposing the photoreceptor with radiation modulated in accordance with an image data for one of a plurality of colors in order to partially discharge the photoreceptor to a first discharge level to produce an image-wise distribution of charges on the photoreceptor corresponding to the image data for the one of a plurality of colors;

at least one applicator to apply a first color liquid toner comprising charged particles of the first color and transparent counter-ions, using an electrode electrically biased to a voltage of between the predetermined charge level and the first discharge level, to the photoreceptor as a function of the image-wise distribution of charges on the photoreceptor to form a first color image, wherein a second substantially uniform predetermined photoreceptor charge level results such that it is lower than the first predetermined charge level but being sufficiently high to subsequently repel liquid toner in areas not subsequently further discharged; and a transferor to transfer at least the first color image and the second color image to a medium to form the multicolored image.

25. The electrophotographic system of claim 24, wherein the photoconductor is in a form of a belt.

26. The electrophotographic system of claim 24, further a second image-wise exposing device for exposing the photoreceptor with radiation modulated in accordance with the image data for a second of the plurality of colors in order to partially discharge the photoreceptor to produce an image-wise distribution of charges on the photoreceptor corresponding to the image data for the second of the plurality of colors in registration with the first color image, wherein the second image-wise exposing device produces the image-wise distribution of charges without erasing the photoreceptor subsequent to the first image-wise exposing of the photoreceptor; and a second applicator to apply a second color liquid toner to the image-wise distribution of charges on the photoreceptor to form a second color image in registration with the first color image.

27. An organic photoreceptor comprising:

an organic photoconductor having a first major surface and a second major surface;

a barrier layer on the first major surface of the photoconductor formed from a barrier layer coating composition comprising a cellulosic resin, a methylvinylether/maleic anhydride copolymer, and a polyamide; and a release layer.

28. The organic photoreceptor of claim 27, wherein the cellulosic resin is selected from the group of a modified methyl cellulose, an unmodified methyl cellulose, and a combination thereof.

29. The organic photoreceptor of claim 27, wherein the barrier layer coating composition comprises a ratio of polyamide:copolymer:cellulose from about 1:0:1 to about 1:1:6.

30. The organic photoreceptor of claim 27, wherein the barrier layer coating composition comprises the cellulosic resin in an amount up to about 15% solids by weight.

31. The organic photoreceptor of claim 27, wherein the barrier layer coating composition comprises the cellulosic resin in an amount of about 0.5% solids by weight to about 2.0% solids by weight.

32. The organic photoreceptor of claim 27, wherein the barrier layer coating composition comprises the cellulosic resin in an amount of 1.5% solids by weight.

33. The organic photoreceptor of claim 27, wherein the barrier layer coating composition comprises the copolymer in an amount up to about 7.5% solids by weight.

34. The organic photoreceptor of claim 27, wherein the barrier layer coating composition comprises the copolymer in an amount of about 0. 15% solids by weight to about 1.0% solids by weight.

35. The organic photoreceptor of claim 27, wherein the barrier layer coating composition comprises the copolymer in an amount of about 0.25% solids by weight.

36. The organic photoreceptor of claim 27, wherein the barrier layer coating composition comprises the polyamide in an amount up to about 15% solids by weight.

37. The organic photoreceptor of claim 27, wherein the barrier layer coating composition comprises the polyamide in an amount of about 0.24% solids by weight to about 2.0% solids by weight.

38. The organic photoreceptor of claim 27, wherein the barrier layer coating composition comprises the polyamide in an amount of about 0.25% solids by weight.

39. The organic photoreceptor of claim 27, wherein the barrier layer coating composition further comprises an optional component.

40. The organic photoreceptor of claim 27, wherein the barrier layer has a thickness of about 0.2 micrometers to about 1.0 micrometers.

41. The organic photoreceptor of claim 27, wherein the organic photoreceptor is in a form of a flexible belt.

* * * * *